US007588404B2

(12) United States Patent
Sonon

(10) Patent No.: US 7,588,404 B2
(45) Date of Patent: Sep. 15, 2009

(54) CONTAINER HANDLING APPARATUS AND CONTAINER

(75) Inventor: James A. Sonon, Cincinnati, OH (US)

(73) Assignee: The Kroger Co., Cincinnati, OH (US)

( * ) Notice: Subject to any disclaimer, the term of this patent is extended or adjusted under 35 U.S.C. 154(b) by 638 days.

(21) Appl. No.: 11/089,429

(22) Filed: Mar. 24, 2005

(65) Prior Publication Data

US 2006/0243726 A1 Nov. 2, 2006

(51) Int. Cl.
*B65G 1/00* (2006.01)

(52) U.S. Cl. ..... 414/280; 414/277; 414/283; 414/661

(58) Field of Classification Search ..... 414/661, 414/277, 280, 283; 294/158; 206/736
See application file for complete search history.

(56) References Cited

U.S. PATENT DOCUMENTS

| | | | | |
|---|---|---|---|---|
| 409,703 | A | 8/1889 | Procter | |
| 480,914 | A | 8/1892 | Bender | |
| 489,711 | A | 1/1893 | Mandioni | |
| 2,137,420 | A | 11/1938 | Soybel | |
| 2,180,691 | A | 11/1939 | Olivier | |
| D153,797 | S | 5/1949 | Heim | |
| 2,547,329 | A * | 4/1951 | Lapham | 414/509 |
| 2,616,578 | A | 11/1952 | Dunham | |
| 2,776,083 | A | 1/1957 | Derman | |
| 2,788,827 | A | 4/1957 | Banner | |
| 3,307,724 | A | 3/1967 | Miller | |
| 3,730,417 | A | 5/1973 | Lawson | |
| 3,860,305 | A | 1/1975 | Bergman | |
| 3,863,829 | A | 2/1975 | Merrill | |
| 3,885,692 | A | 5/1975 | Anderson, Jr. | |
| 4,211,359 | A | 7/1980 | Chafinn | |
| 4,382,504 | A | 5/1983 | Vesborg | |
| 4,538,953 | A | 9/1985 | Abramson, Jr. | |
| 4,542,547 | A | 9/1985 | Sato | |
| 4,697,699 | A | 10/1987 | Schneider | |
| 4,708,575 | A | 11/1987 | Farmer et al. | |
| 4,726,476 | A | 2/1988 | Smith | |
| 4,752,179 | A | 6/1988 | Seaberg | |
| 4,809,847 | A | 3/1989 | Schneider | |
| 4,927,320 | A | 5/1990 | Olson | |
| 5,038,998 | A | 8/1991 | Morris et al. | |
| 5,450,962 | A | 9/1995 | Uitz | |
| 5,494,214 | A | 2/1996 | Fleury et al. | |

(Continued)

OTHER PUBLICATIONS

Non-Final Office Action; mailed Nov. 19, 2007; U.S. Appl. No. 11/089,523.

(Continued)

*Primary Examiner*—Michael S Lowe
(74) *Attorney, Agent, or Firm*—Thompson Hine LLP

(57) ABSTRACT

A container handling apparatus for use in loading and transporting a container from a first location to a second location is provided. The container handling apparatus includes a mast and support structure for supporting the container thereon. The support structure is vertically positionable relative to the mast. The container handling apparatus also includes a container interlocking member including an engaging portion for use in releasably engaging a container. The container interlocking member is horizontally positionable relative to the support structure and configured to provide a pivot axis about which the container can pivot relative to the interlocking member when engaged with the container.

18 Claims, 13 Drawing Sheets

U.S. PATENT DOCUMENTS

| | | | | |
|---|---|---|---|---|
| 5,524,789 | A | | 6/1996 | Jackman |
| 5,555,975 | A | | 9/1996 | Smith |
| 5,595,304 | A | | 1/1997 | Timmins |
| 5,690,231 | A | | 11/1997 | Erickson |
| 5,769,595 | A | | 6/1998 | Pearce et al. |
| 5,826,728 | A | | 10/1998 | Sheffer |
| 5,839,650 | A | | 11/1998 | Sheffer |
| 5,957,294 | A | | 9/1999 | Kanter |
| 6,006,918 | A | | 12/1999 | Hart |
| 6,029,886 | A | | 2/2000 | Sheffer |
| 6,056,177 | A | | 5/2000 | Schneider |
| 6,059,514 | A | | 5/2000 | Sanchez |
| 6,129,502 | A | * | 10/2000 | Marcelli ..... 414/661 |
| 6,131,376 | A | | 10/2000 | Grey et al. |
| 6,189,776 | B1 | | 2/2001 | Smith et al. |
| 6,209,741 | B1 | | 4/2001 | Boucher-Giles |
| 6,260,707 | B1 | | 7/2001 | Harris |
| D466,300 | S | | 12/2002 | Walsh |
| D466,690 | S | | 12/2002 | Walsh |
| 6,516,951 | B2 | | 2/2003 | Sears et al. |
| 6,726,046 | B2 | | 4/2004 | Orset |
| 6,755,306 | B2 | | 6/2004 | Maus |
| 6,874,981 | B1 | | 4/2005 | Krawczyk et al. |
| 6,955,273 | B2 | | 10/2005 | Hartwall |
| 7,090,905 | B1 | | 8/2006 | Brauner |
| 7,175,040 | B2 | | 2/2007 | Lorenz et al. |
| D544,175 | S | | 6/2007 | Valentinsson |
| 2004/0026296 | A1 | | 2/2004 | Nesting |
| 2004/0104230 | A1 | | 6/2004 | Lorenz et al. |
| 2004/0163994 | A1 | | 8/2004 | Gardner et al. |
| 2004/0256385 | A1 | | 12/2004 | Hartwall |
| 2006/0060580 | A1 | | 3/2006 | Lorenz et al. |

OTHER PUBLICATIONS

Non-Final Office Action; mailed Dec. 28, 2007; U.S. Appl. No. 11/089,424.

* cited by examiner

GO TO FIG. 19F
140
142
144
145
146
148
150
152
154
155
A
10
18
24
30
50
54
58
69

FROM

GO TO 10
20
30
50
120
142
145
156
158
160
162
164

FROM Fig. 19J
GO TO FIG. 20F
140
168
170
172
176
120
145
10
50
50'
52,58
B
18
22
174

FROM 178
180
182
186
188
10
22
50
50'
145
155
174
184

CONTAINER HANDLING APPARATUS AND CONTAINER

TECHNICAL FIELD

The present application relates to container handling devices and more particularly to a container handling device capable of pushing and pulling a container.

BACKGROUND

Palletized loads are commonly used to transport product. Typically, the product is placed on a pallet that rests on the ground and the pallet is moved from one location to another using a forklift.

To provide greater flexibility in palletizing, slipsheet palletizing has been proposed where a thin sheet of material is interposed between adjacent units of product that are stacked one on top of the other. To remove the top unit, a modified forklift or lift truck having a gripping device is used. The gripping device can grasp an edge of the slipsheet and pull the slipsheet including the product disposed thereon onto the forklift or lift truck.

While use of a forklift and palletized loads may be suitable for certain products at some stages during the distribution process such as in a large warehouse, they are not particularly well-suited to accomplish many downstream processes. For example, a large forklift is not well-suited where greater flexibility may be important such as in re-stocking store displays from an on-site storage location. Additionally, forklifts and lift trucks tend to be relatively large and may be somewhat unsuitable for use at many retail locations.

SUMMARY

In an aspect, a container handling apparatus for use in loading and transporting a container from a first location to a second location is provided. The container handling apparatus includes a mast and support structure for supporting the container thereon. The support structure is vertically positionable relative to the mast. The container handling apparatus also includes a container interlocking member including an engaging portion for use in releasably engaging a container. The container interlocking member is horizontally positionable relative to the support structure and configured to provide a pivot axis about which the container can pivot relative to the interlocking member when engaged with the container.

In another aspect, a container capable of being engaged by a container handling apparatus is provided. The container includes a container body including a bottom. The container body is convertible between an enclosed configuration where an interior volume is enclosed by the container body and a display configuration where first and second access openings provide access to the interior volume. The container includes device engagement structure sized and configured to receive an interlocking member of a container handling apparatus. The device engagement structure is configured to engage with the interlocking member to allow the container handling apparatus to move the container.

In another aspect, a method of handling a container using a container handling apparatus includes releasably engaging a container with a container interlocking member of the container handling apparatus. The container has device engagement structure that is configured to mate with the container interlocking member. The container is lifted using the container handling apparatus such that the container interlocking member provides a pivot axis about which the container pivots relative to the interlocking member. The container is located on a support member of the container handling apparatus by pulling the container in a direction toward the container handling apparatus using the interlocking member.

The details of one or more embodiments are set forth in the accompanying drawings and the description below. Other features, objects, and advantages will be apparent from the description and drawings, and from the claims.

DETAILED DESCRIPTION

Figure 1:
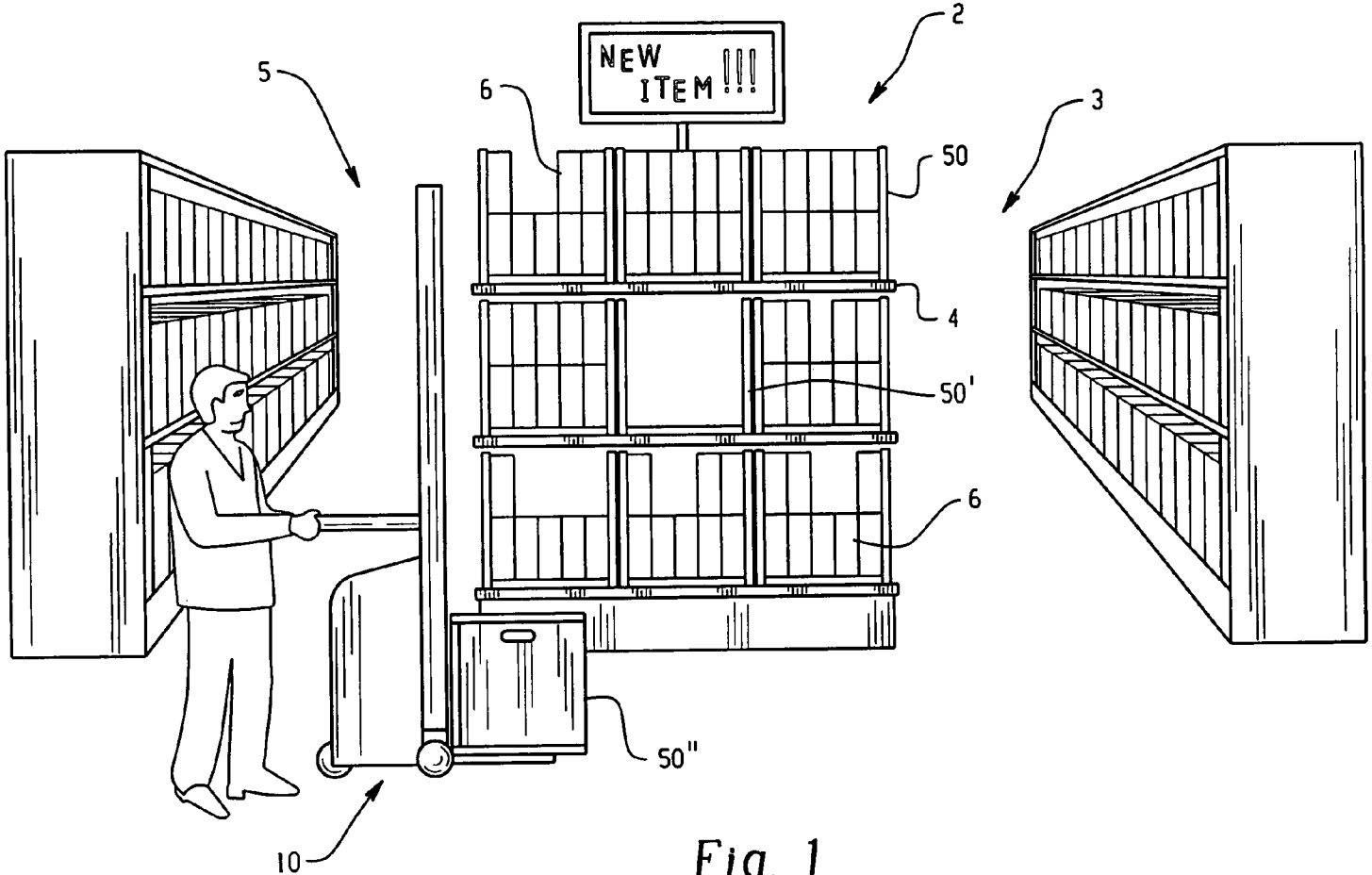
FIG. 1 is a front view of an end-aisle store display including containers in a display configuration.

Referring to FIG. 1, an end-aisle store display 2 is disposed between aisles 3 and 5. The store display 2 includes multiple, display-ready containers 50 placed upon shelves 4 of the display 2. Each container 50 has a prepackaged amount of product 6 disposed therein and is capable of displaying the product 6 for customer viewing and purchase. While most of the containers 50 are illustrated as being at least partially filled with product 6, container 50' is empty because all of the product 6 disposed therein has been removed. A container handling apparatus 10 is used to transport a filled container 50" from a storage location (not shown) to the display 2. The handling apparatus 10 can, itself, locate the container 50" both vertically by lifting the container 50" and horizontally by pushing the container 50" to facilitate positioning of the container 50" on the display 2. The handling apparatus 10 can also remove a container 50 from the shelf 4 by pulling the container 50 therefrom.

Figure 2:
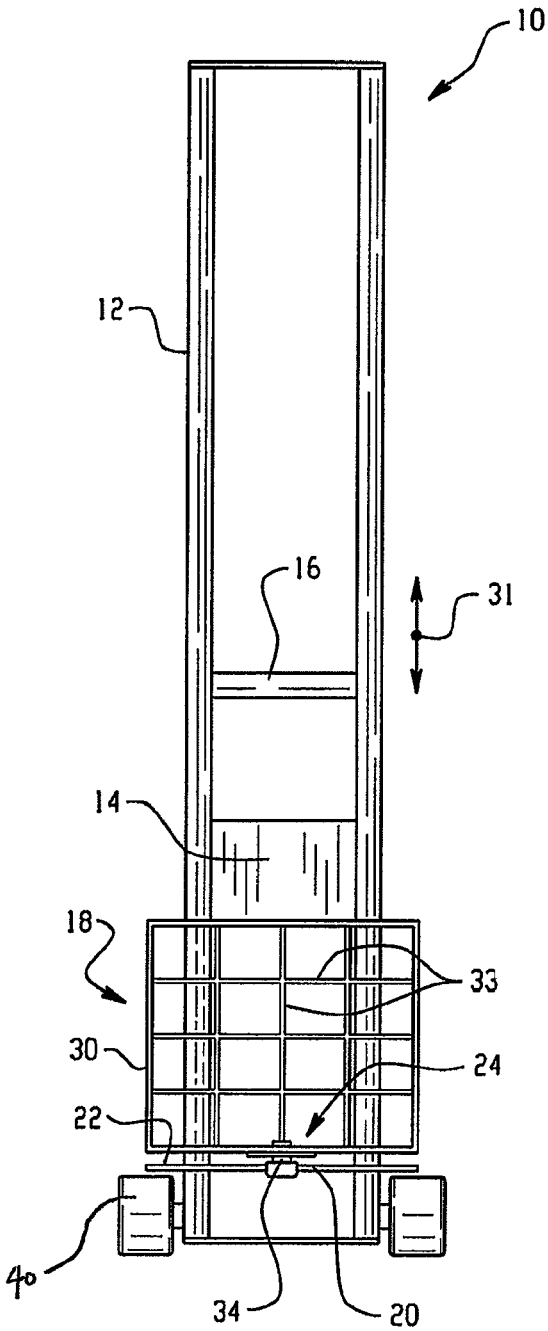
FIG. 2 is a front view of an embodiment of a container handling device for a container.

Referring to FIG. 2, the handling apparatus 10 includes a mast 12 and a base 14 connected to the mast 12. The base 14 can include, for example, a battery (not shown) and/or other components for automating aspects of the handling apparatus. The mast 12 may include multiple stages (not shown) where a first stage moves relative to a second stage. The stages may or may not be nesting. A handle 16 is also connected to the mast 12 and can facilitate user control of the handling apparatus 10. A container manipulation device 18 is provided that is vertically and horizontally positionable relative to the mast 12.

In some embodiments, wheels 40 may be driven by a motor (e.g., an electric motor connected to a power source, such as a battery). In some instances, the handling apparatus 10 is moved manually under the power of a user with the user walking behind the handling apparatus 10. In some embodiments, the handling apparatus 10 includes a controller (not shown) that allows the user to control movement of the container manipulation device 18 and/or wheel rotation in cases where the handling apparatus 10 is motorized.

Figure 3:
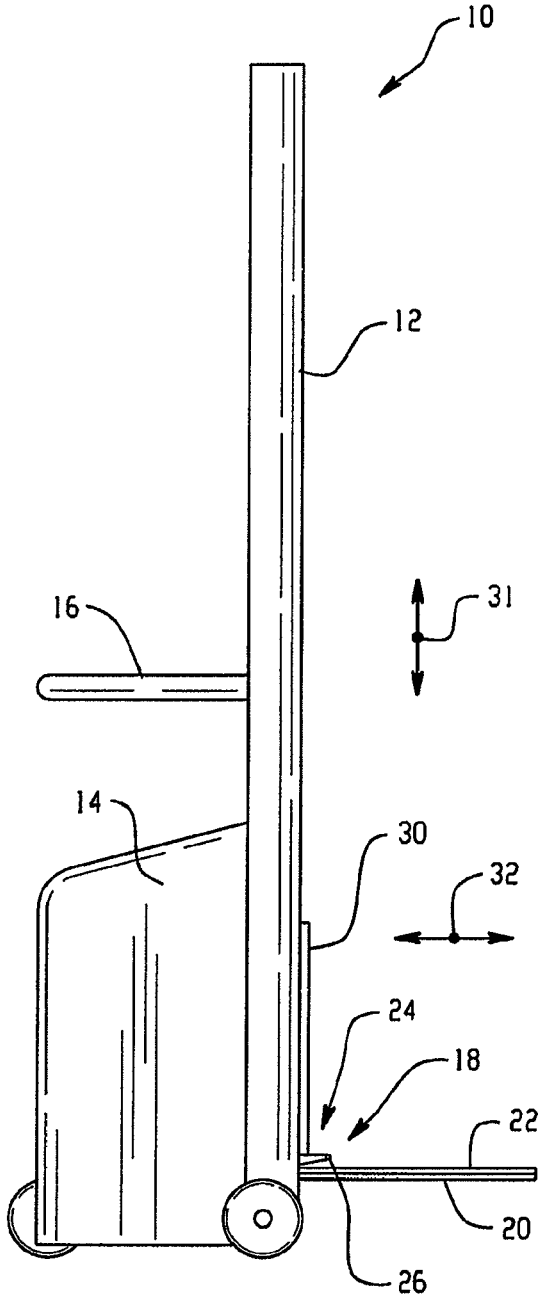
FIG. 3 is a side view of the transport device of FIG. 2.

Referring also to FIG. 3, the container manipulation device 18 can lift, lower, push and pull a container during a load/unload operation. In particular, container manipulation device 18 includes a support member 20 that forms a planar support surface 22 upon which a container can rest and a container interlocking member 24 that can engage a container to pull the container along the support surface 22. The support member 20 is moveable in a vertical direction 31 relative to the mast for vertically positioning a container at a desired elevation. The interlocking member 24 is carried by the support member 20 and is moveable in a horizontal direction 32 relative to both the mast 12 and the support member 22 for horizontally positioning a container at a desired location.

The support member 20 can be formed of any suitable material including metal, plastic, low friction materials, such as nylon, polytetrafluoroethylene (PTFE), etc. A low friction coating such as Teflon® or Formica® may be applied to the support member 20 to form a low friction support surface 22. In some embodiments, the support member 20 may include a dynamic support (e.g., an array of rollers, balls, etc.) upon which an article can rest. By dynamic support, we refer to a support capable of interacting with a load supported thereon to actively facilitate movement of the load relative to a reference, such as mast 12. Use of low friction or dynamic supports can be particularly advantageous where relatively heavy loads are moved (e.g., 100 pounds or more). Examples of various dynamic supports can be found in pending U.S. patent application Ser. No. 11/076,016, entitled "Storage System and Method," filed Mar. 9, 2005, the details of which is incorporated by reference as if fully set forth herein.

A container guard 30 includes a central mesh portion 33, e.g., formed of metal, netting or plastic wire, however, other configurations are possible, such as a solid portion rather than a mesh portion. The solid portion could be formed of a transparent material, e.g., to allow a user to see through the container guard 30 while moving a container. The container guard 30 can inhibit spilling of articles from the container when the container is being transported and can serve as a pushing element for applying a pushing force to the container.

Figure 4:
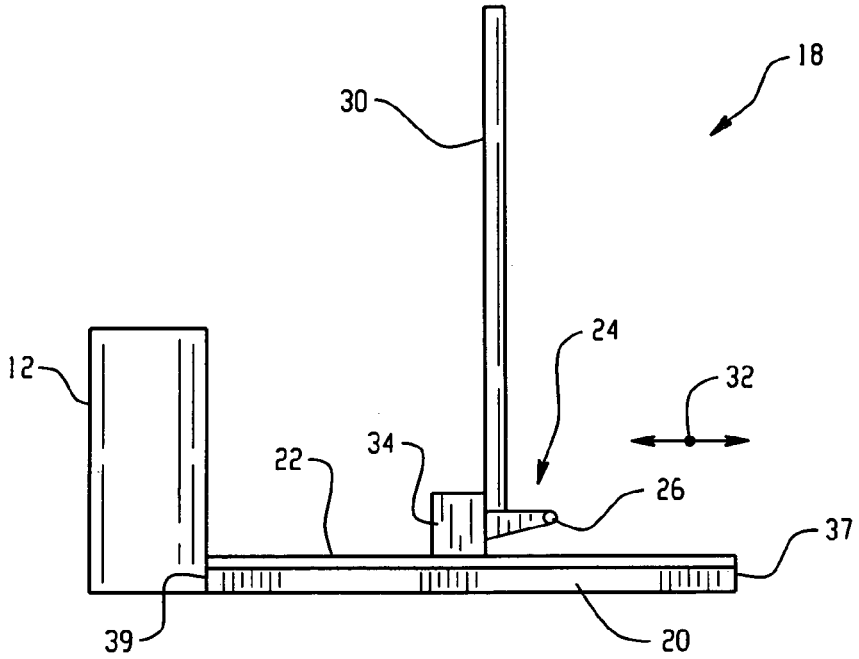
FIG. 4 is a side view of an embodiment of a container manipulation device.
Figure 5:
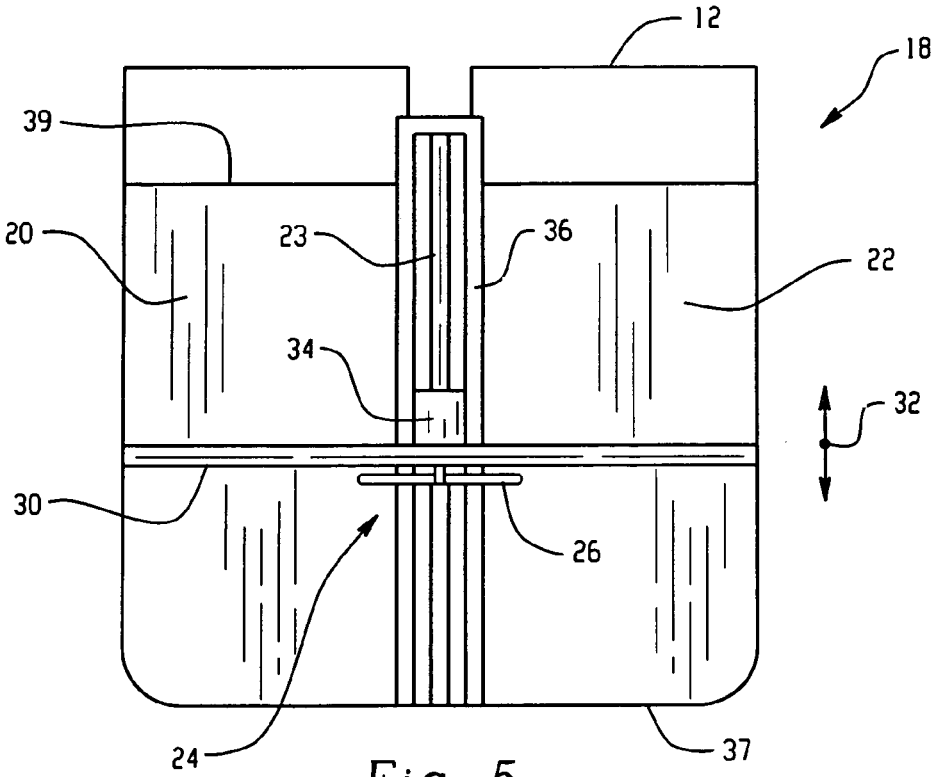
FIG. 5 is a top view of the container manipulation device of FIG. 4.

Referring also to FIG. 4, a mover 34 carries each of the engaging member 26 and the container guard 30. As can be seen most clearly by FIG. 5, the mover 34 rides along the support surface 22 in a track 36 carried by the support member 22. The track 36 extends substantially linearly between a front edge 37 of the support member 20 relatively far from the mast 12 and an opposite rear edge 39 of the support member 20 relatively near to the mast 12. While a linear track 36 is illustrated, the track may not be linear. Additionally, other arrangements may be utilized to move the interlocking member 24 and the container guard 30. For example, the interlocking member 24 and container guard may be capable of independent movement. The mover 34 may ride along a guide rail. In some embodiments, the interlocking member 24 and/or container guard 30 may not contact or ride along the support member 20 as one or both move horizontally. Instead, the interlocking member 24 and/or container guard 30 may overhang the support surface 22 and be carried, for example, by a mechanical linkage configured to extend and retract the interlocking member 24 and/or container guard 30.

Figure 6:
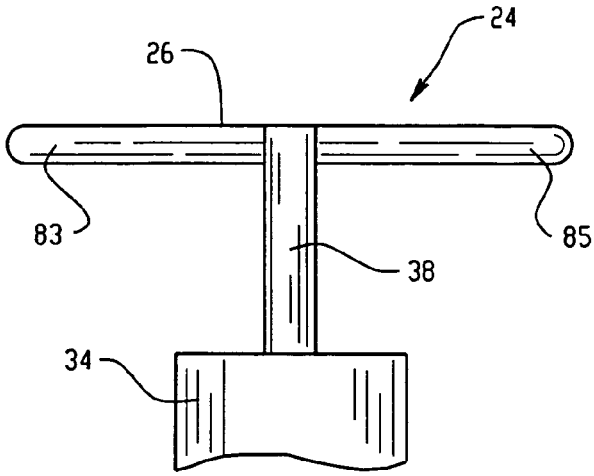
FIG. 6 is a top view of an embodiment of an interlocking member.
Figure 7:
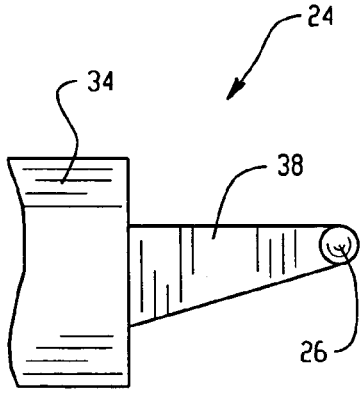
FIG. 7 is a side view of the interlocking member of FIG. 6.

Referring to FIG. 6, the interlocking member 24 includes engaging member 26 disposed at a free end of the interlocking member 24 and a connecting member 38 connecting the interlocking member 24 and the mover 34. Referring also to FIG. 7, the engaging member 26 and connecting member 38 form a substantially T-shaped projection extending integrally from the mover 34 having opposite free ends 83, 85 located at either side of the connecting member 38. While FIGS. 6 and 7 illustrate a substantially T-shaped interlocking member 24, other configurations are possible such as a substantially L-shaped interlocking member, a substantially U-shaped interlocking member, etc.

Any suitable method or device can be used to move the support member 20 and the interlocking member 24. In one embodiment, one or more electric motors (not shown) are used to move the support member 20 vertically and the mover 34 horizontally. The motor may be connected to a power source, such as a battery (not shown) and may or may not be located in the base 14. A transmission belt, chain or other mechanical connection 23 (FIG. 5) can be used to connect the motor to the support member 20 and/or mover 34. Air and/or hydraulic cylinders (not shown) may be used to move the support member 20 vertically and/or the interlocking member 24 horizontally. The cylinders may be rodless. The air or hydraulic cylinder may be connected directly to the container manipulation device 18, or it may be mechanically connected using a linkage.

Figure 8:
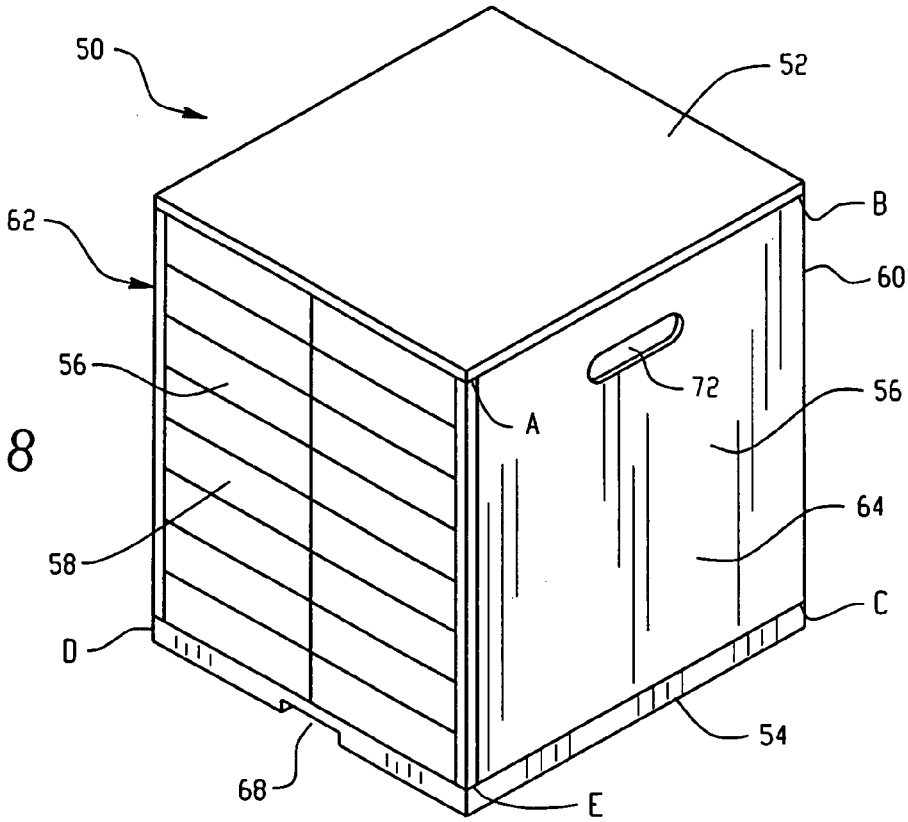
FIG. 8 is a prospective view of an embodiment of a container suitable for use with the transport device of FIG. 2 in an enclosed configuration.

Referring now to FIG. 8, an example of a container 50 suitable for use with handling apparatus 10 includes a top wall 52, a bottom wall 54 and side walls 56 extending between the top and bottom walls. Container 50 is convertible between an enclosed configuration where an interior volume is fully enclosed by a front wall 58, a top wall 52, a rear wall 60, bottom wall 54 and end walls 62 and 64, a display configuration where the front wall 58 and top wall 52 are moved relative to the bottom wall about joints A and B to provide side and top access openings 28 and 26, and a collapsed configuration where each of the walls 52, 54, 58, 60, 62 and 64 are moved about their respective joints A-E to stack on the bottom wall. Configurable display containers are described in greater detail in U.S. patent application Ser. No. 11/089,523, entitled "Configurable Display Container," filed the same day as the instant application, the details of which are incorporated by reference as if fully set forth herein. In some embodiments, container 50 has only one or more of an enclosed, display and collapsed configuration.

Container 50 includes device engagement structure 68 located at the bottom wall 54 that is capable of engagement with interlocking member 24. Engagement between the device engagement structure 68 and the interlocking member 24 enables the handling apparatus 10 to pull the container 50 onto the support structure 20 and to lift the container of an underlying surface, such as a shelf.

Figure 9:
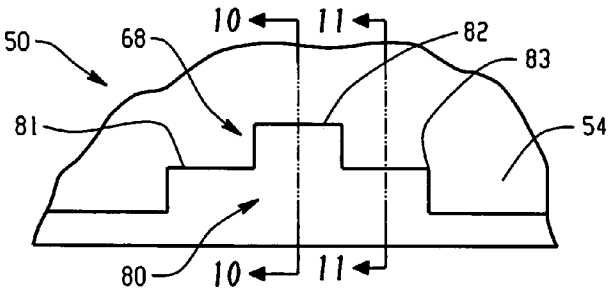
FIG. 9 is a detail view of an embodiment of a device engagement structure.

Referring to FIG. 9, the device engagement structure 68 of the container 50 is a recess 80 that is sized and configured to receive the engaging member 26. In the illustrated embodiment, the recess 80 extends inwardly from a surface of the bottom wall 54, however, other configurations are possible, such as forming the recess 80 to extend inwardly from an outer surface of one or more of the side walls 56. The recess 80 is contoured to form a notch portion 82 that is disposed between two side portions 81 and 83.

Figure 10:
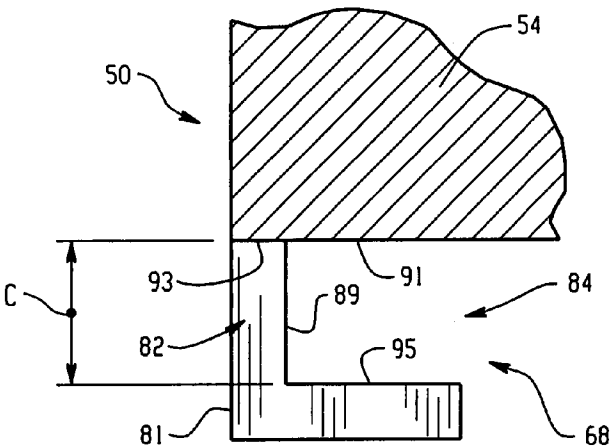
FIG. 10 is a side, section view of the device engagement structure of FIG. 9 along line 10-10.

Referring to FIG. 10, the side portions 81 include an inwardly facing, U-shaped receiving portion 84 disposed on opposite sides of the notch portion 82. U-shaped receiving portions 84 include a lower surface 95, a side surface 89 and a top surface 91. Notch portion 82 provides a clearance C between the lower surface 95 and upper notch surface 93.

Figure 11:
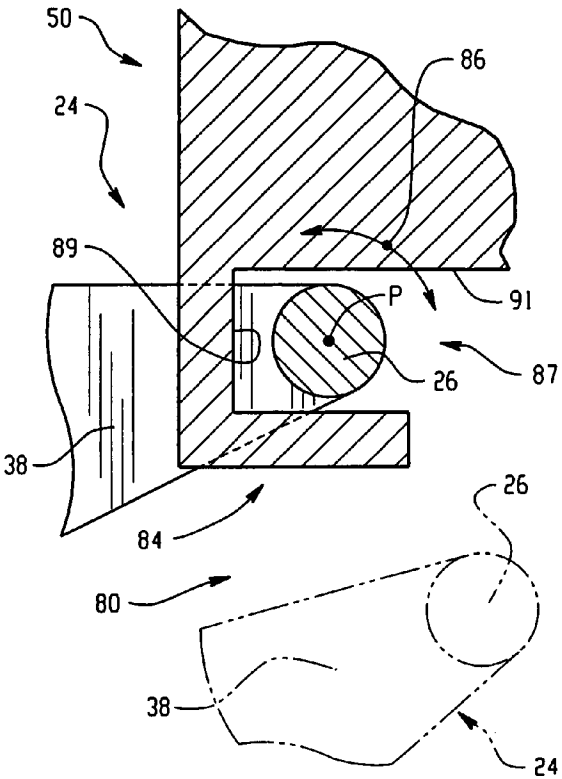
FIG. 11 is a side, section view of the device engagement structure along line 11-11 of FIG. 9 engaged with the interlocking member of FIG. 6.

Referring now to FIG. 11, notch portion 82 allows the interlocking member 24 to move vertically with the engaging member 26 disposed within the recess 80. As shown by the dotted lines, interlocking member 26 is located beneath the U-shaped receiving portion 84 when initially disposed within recess 80. Once the engaging member 26 is located behind the U-shaped receiving portion 84 by extending the interlocking member 24, the interlocking member 24 can be moved vertically by raising the support member 20 such that the notch portion 82 receives the connecting member 38 of the interlocking member 24. This vertical motion of the interlocking member 26 can place the engaging member 26 at an entrance 87 to the U-shaped receiving portion 84. Retracting interlocking member 24 locates engaging member 26 within the U-shaped receiving portion 84. Additional retraction of the interlocking member 24 engages the engaging portion 26 with the side surface 89 of the U-shaped receiving portion 84 and pulls container 50 in a direction toward the handling apparatus 10. Similarly, additional vertical motion of the interlocking member 24 engages the engaging portion 26 with top surface 91 of the U-shaped receiving portion 84 and lifts at least a portion of the container 50.

Referring still to FIG. 11, once located within the U-shaped receiving portion 84, the engaging member 24 forms a pivot axis P about which the container 50 can pivot in the direction of arrow 86. This can be desirable when lifting an edge of the container 50 off of a support surface on which it rests prior to or while pulling the container 50 toward the handling apparatus 10. By providing P, relatively little torque is applied to the engaging structure 24 and the device engagement structure 68 of the container 50. This can be particularly advantageous when loading or unloading a relatively heavy load.

Figure 12:
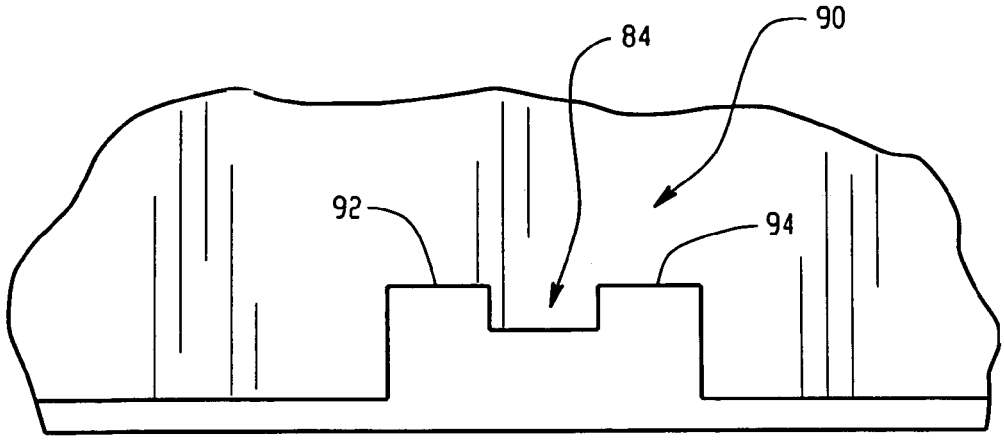
FIG. 12 is a detail view of another embodiment of a device engagement structure.
Figure 13:
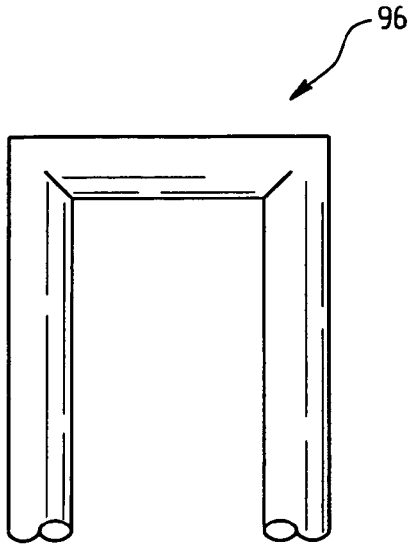
FIG. 13 is a top, partial view of another embodiment of an interlocking member.
Figure 14:
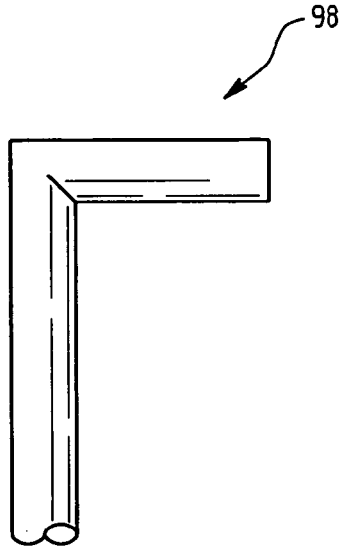
FIG. 14 is a top, partial view of another embodiment of an interlocking member.

In an alternative embodiment as shown by FIG. 12, the container engagement structure 90 is contoured to include a first notch portion 92 and a second notch portion 94 disposed on opposite sides of a U-shaped portion 84. Container engagement structure can be sized and configured to receive U-shaped interlocking member 96 such as that shown by FIG. 13 or an L-shaped interlocking member 98 such as that shown by FIG. 14. In other embodiments, the container engagement structure has only a single notch portion, more than two notch portions and/or more than two U-shaped receiving portions. In some instances, the receiving portion 84 may not be U-shaped. In these instances, the receiving portion may only include a side surface 89 and a top surface 91, but not a lower surface 95 (FIG. 10).

The above-described container 50 and handling apparatus 10 can be used at any desired type of facility including club stores, warehouses, retail stores, etc. For example, in the illustrated embodiments, handling apparatus 10 and container 50 may be used at a grocery store where product is stored at a storage location that is removed from a retail location. In this instance, it may be desirable to fill container 50 with "fast moving" items, such as eggs, for example, at a production facility. By "fast moving" items, we mean that relatively small percentage of items that drive a relatively large percentage of product movement from the storage location to the retail location for consumer purchase. Examples of fast moving items include, for example, sale items at certain price points, certain baked goods such as muffins, bagged produce such as bags of potatoes and bags of onions and certain granular products such as corn meal and flower.

By using handling apparatus 10 and container 50, a user can move more product to the shelf than could be done manually in a single run. It may be desirable to fill container 50 with items (e.g., promotional and seasonal items) at a regional distribution or consolidation center. Container 10, 60 may also be well-suited for handling bagged products such as cat litter, pet food, sugar, etc. by providing additional protection against bag rupture as the product is being placed on a display for purchase.

Figure 15:
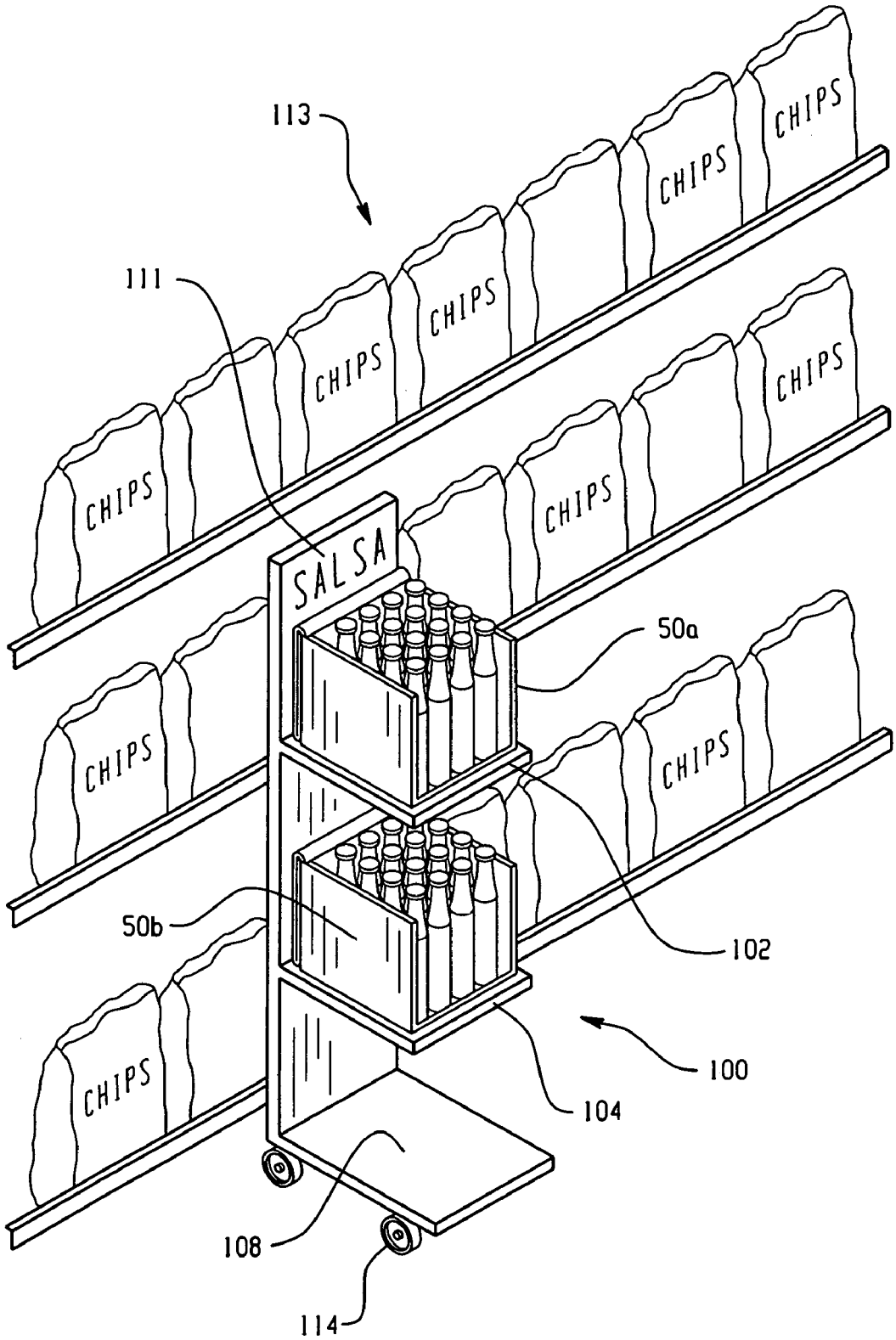
FIG. 15 is a perspective view of an embodiment of an aisle display.

Referring now to FIG. 15-19, the above-described container 50 and handling apparatus 10 can be used in conjunction with in-store displays. FIG. 15 illustrates an example of a aisle display 100 that includes two containers 50*a* and 50*b*. Container 50*a* rests on an upper shelf 102 (e.g., between about three feet and about five feet, such as about four feet from the ground) that allows for placement of the container 50*a* the customer's eye level. Container 50*b* is rests on a lower shelf 104 that is spaced from the ground (e.g., between about one foot to about three feet, such as about two feet), for example, to reduce the amount of bending a customer must do to reach an item supported on the lower shelf 104. The aisle display 100 includes a base 108 and wheels 114 that allow for re-positioning of the aisle displays, e.g., in the store. In some instances, the aisle display 100 may accept signage 111 or graphics that can convey a brand or "Great Price!" message. The aisle display 100 can be used, for example, to reinforce value pricing to price-sensitive shoppers and/or to place supplemental inventory in aisles 113 in support of promotional pricing.

Figure 17:
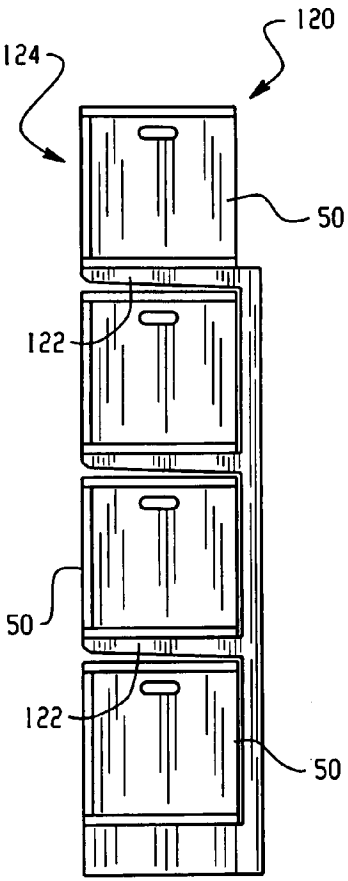
FIG. 17 is a side view of an embodiment of an one-sided display.
Figure 16:
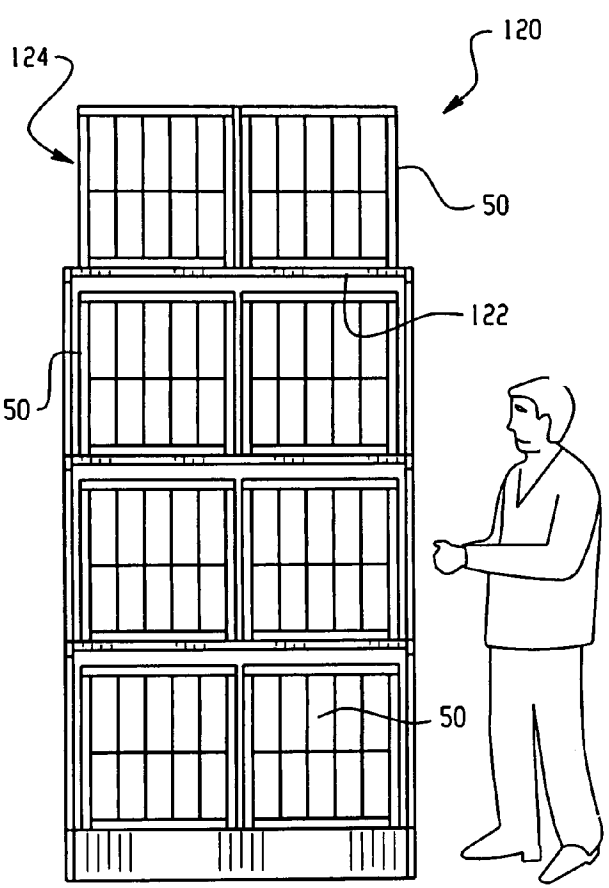
FIG. 16 is a front view of an embodiment of a display.
Figures 19A, 19B, 19C, 19D, 19E:
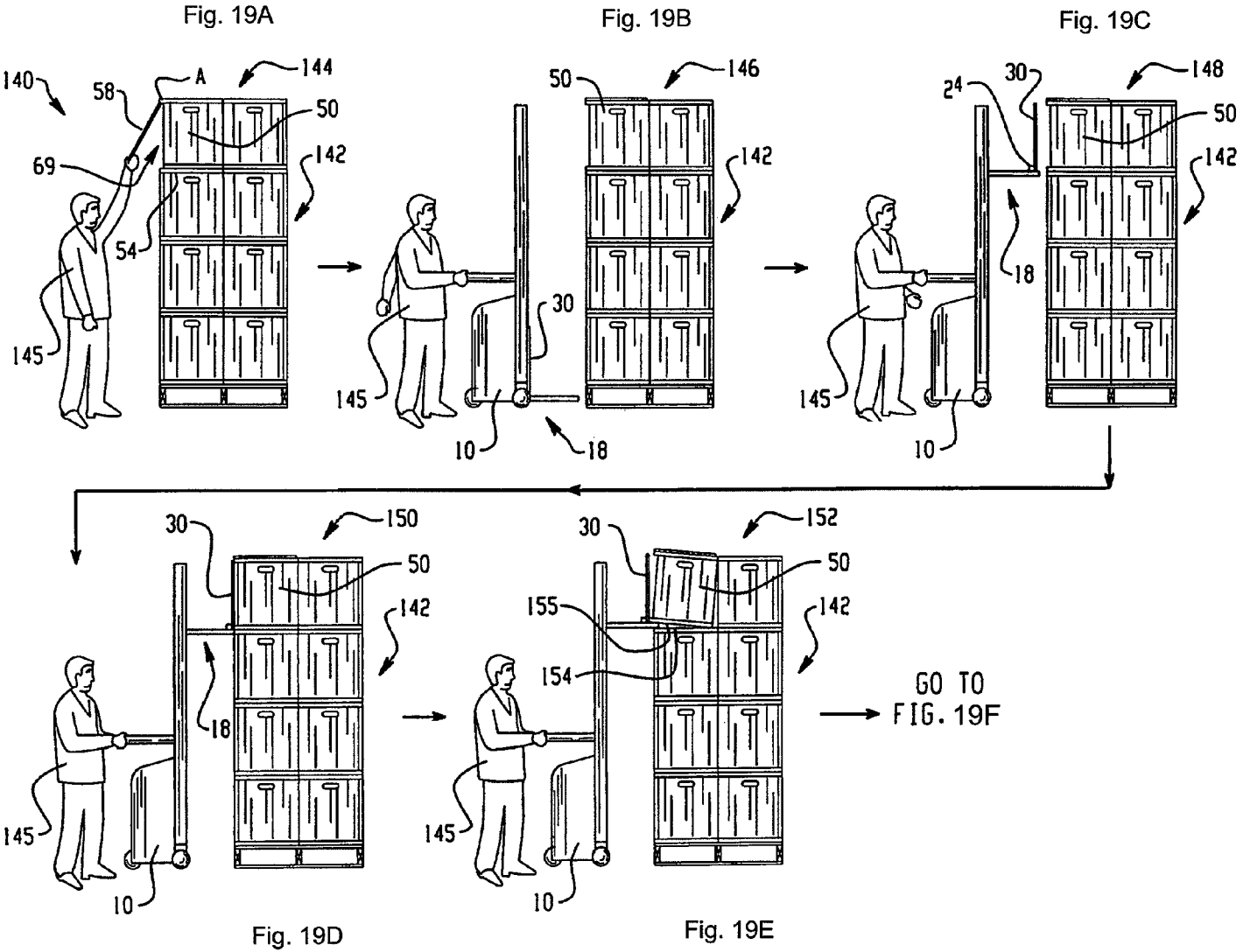
FIGS. 19A through 19J show one embodiment of method of restocking a display using the transport device of FIG. 2 and the container of FIG. 8.
Figures 19E, 19F, 19G, 19H, 19I, 19J, 20A:
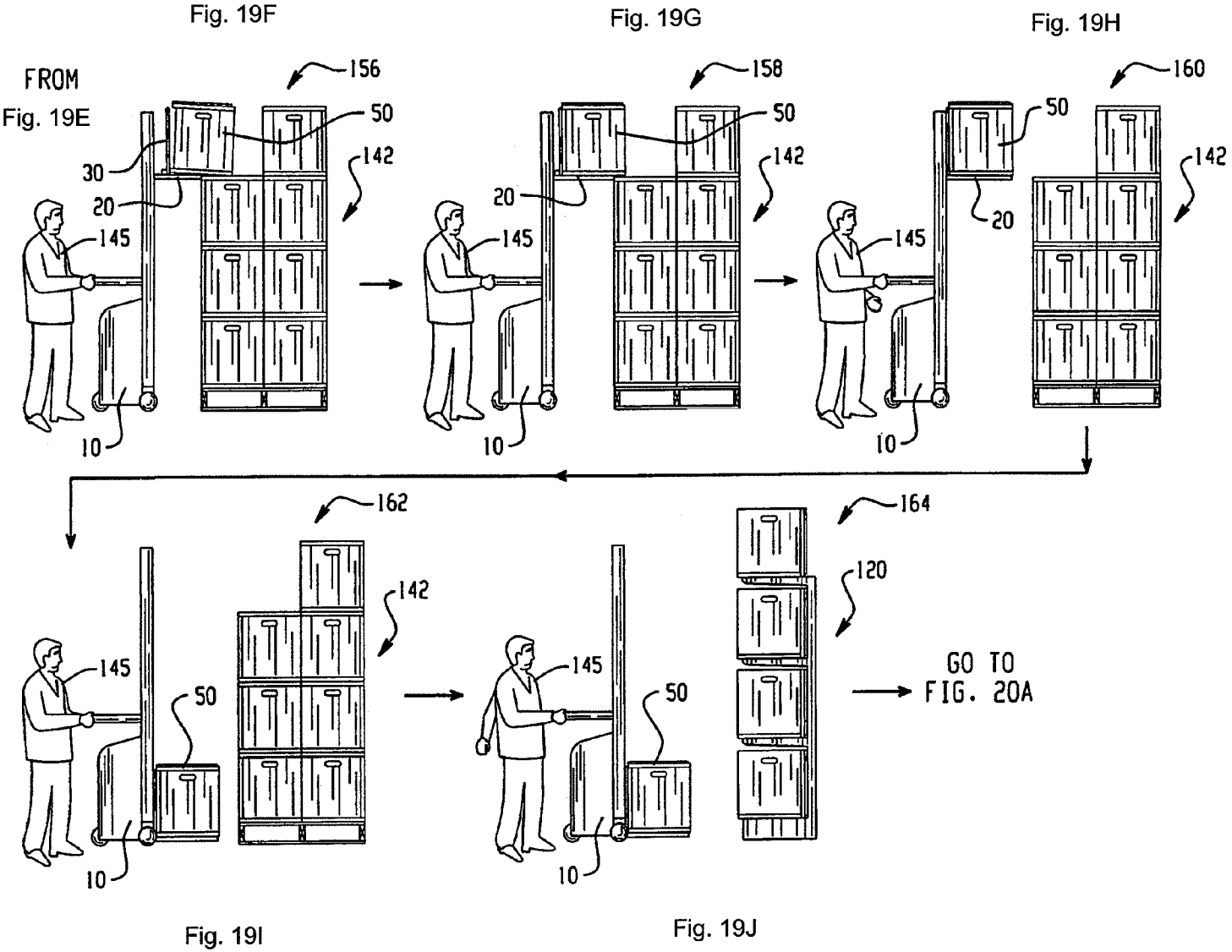
FIGS. 20A through 20J show one embodiment of a method of restocking a display using the transport device of FIG. 2 and the container of FIG. 8.
Figures 20A, 20B, 20C, 20D, 20E:
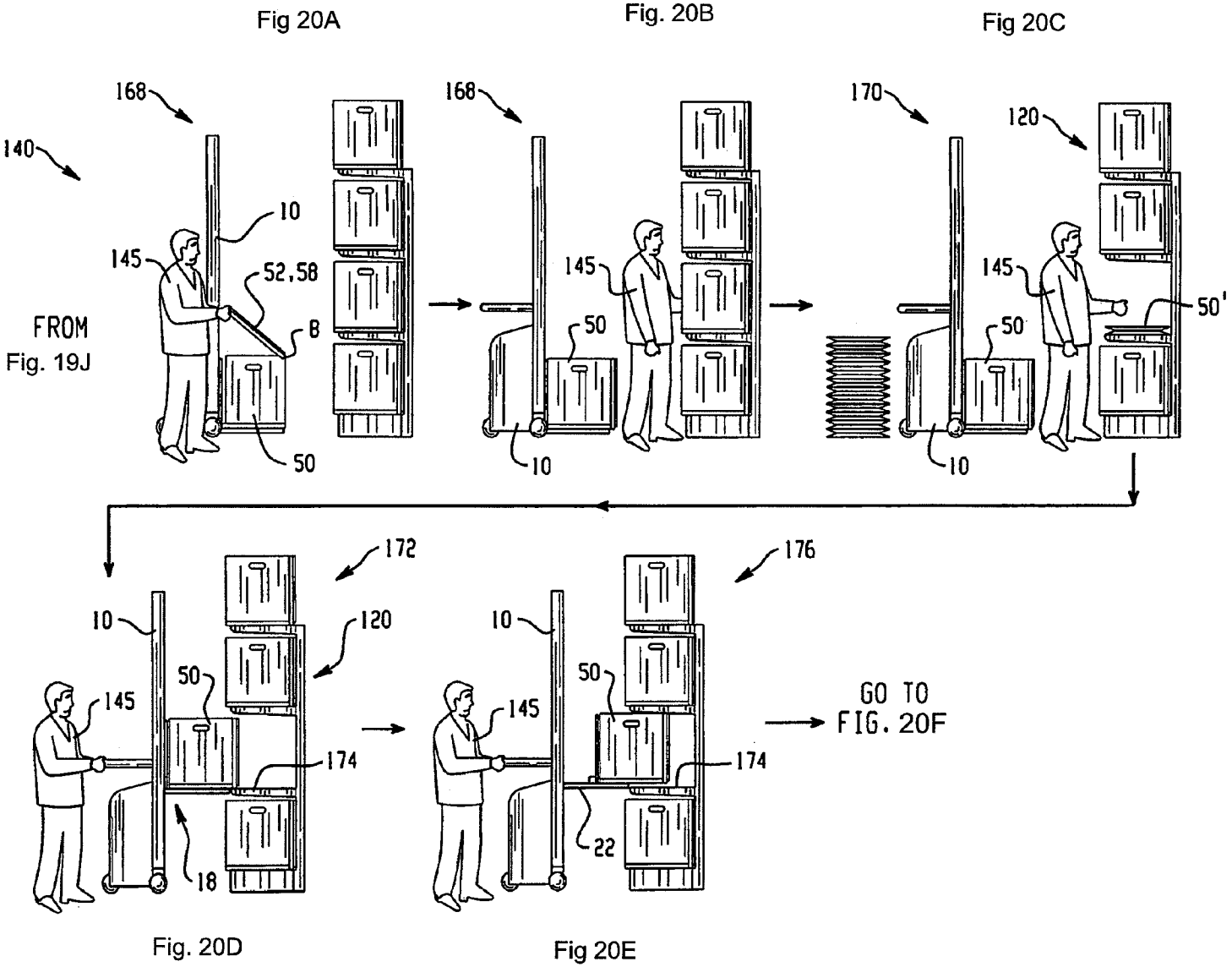
Figures 20E, 20F, 20G, 20H, 20I, 20J:
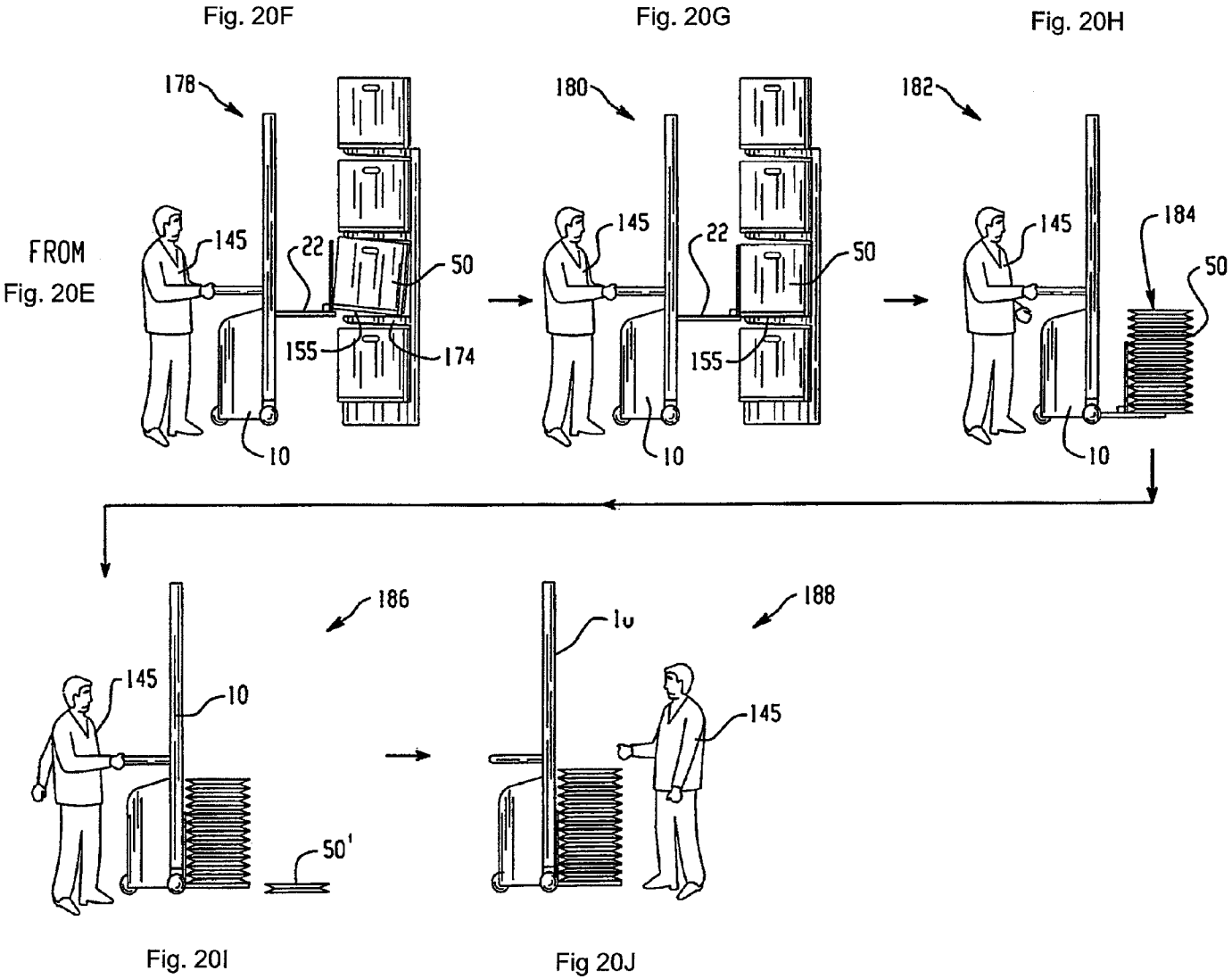

Referring now to FIGS. 16 and 17, a single-sided display 120 includes multiple containers 50 resting on shelves 122. Display 120 may be suitable as an end-aisle display or as a seasonal display. Display 120 includes an uppermost, backstock level 124 that can be used to restock a lower level once all product is moved from a particular container 50 placing a replacement container 50 full of product within relatively close proximity to an empty container 50. Once all product is removed from a particular container 50, the container 50 can be placed in the collapsed configuration as previously described and removed from the display 120. A replacement container 50 can be removed from the backstock level 124 and placed at the empty container's location on the display 120.

Figure 18:
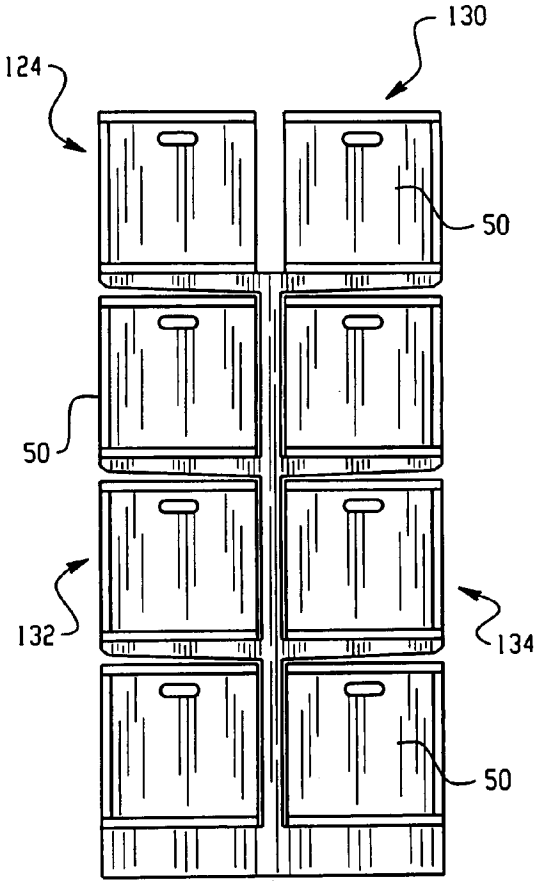
FIG. 18 is a side view of an embodiment of a two-sided display.

Referring to FIG. 18, as an alternative to single-sided display 120, a two-sided display 130 includes a front side 132 and a back side 134, each of the sides 132 and 134 including containers 50. The two-sided display may be suitable for, e.g., soft drinks, bottled water, bagged potatoes and/or onions. It can be used across adjacent aisles or in open spaces within a store.

Where containers 50 are used with in-store displays, such as those described above, it may be desirable to size the container 10, 60 to achieve a desirable viewing position for product within the container 10, 60. Additionally, in some embodiments, the containers 50 are black in color, which can minimize the presence of the containers 50 to consumers, which can emphasize the product. Alternatively, the containers 50 may be any other suitable color such as red, white, blue, green, yellow, or any combination of the primary colors. In some instances, it may be desirable to match the container 50 color with a store display color or for consistency with colors associated with a particular holiday, such as Christmas, Valentine's Day, Easter, Halloween, Thanksgiving, etc.

Referring now to FIGS. 19A through 19J and FIGS. 20A through 20J a method 140 of container 50 handling, e.g., at a store location using the handling apparatus 10 is provided. The method 140 may be suitable to restock a store display, such as the display 2 of FIG. 1 and display 100 of FIG. 15. Referring to FIGS. 19A through 19J, the method includes a user 145 approaching a pallet 142 of stacked containers 50 at step 144. Containers 50 forming the palletized unit 142 may have been filled at an off-site location, such as at a production facility or at a warehouse, or the containers may have been filled on-site at a retail store location.

Figure 21:
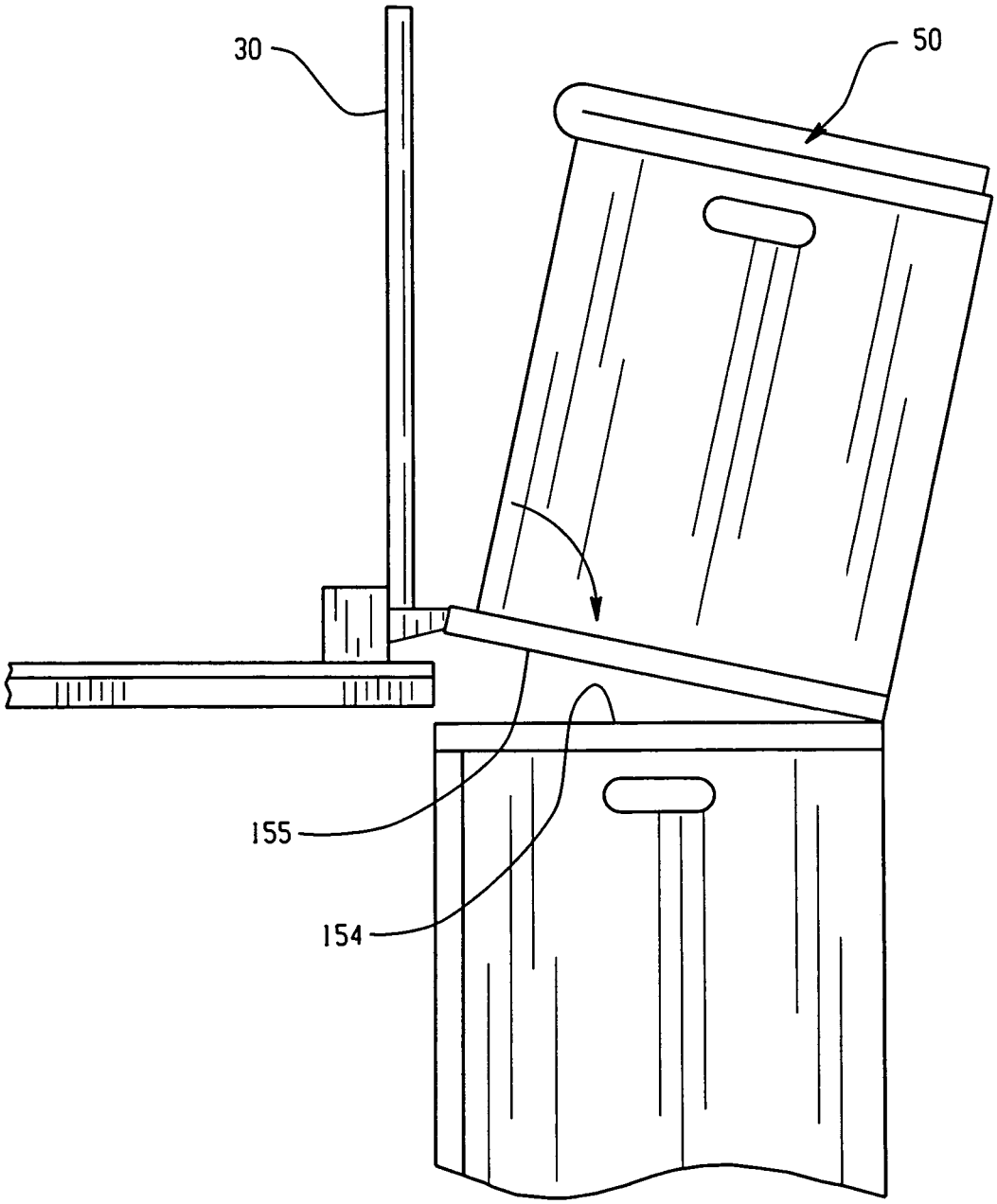
FIG. 21 is a detail view showing the container of FIG. 8 raised off a support structure using the handling device of FIG. 2.

A side access opening 69 is provided to the container 50 that is to be transported from the pallet 142. As described above, the side access opening 69 is provided by pivoting front wall 58 at joint A relative to bottom wall 54. At step 146, the user 145 retrieves the handling apparatus 10 and approaches the pallet 142 of stacked containers 50. At a positioning steps 148 and 150, the container manipulation device 18 is raised vertically to align the interlocking member 24 with the device engagement structure 68 (FIGS. 9 and 10) of the container 50. The interlocking device 24 is moved horizontally to locate the engagement member 26 within the recess 80 and behind the entrance 87 to the U-shaped receiving portion 84 (see FIG. 10). At step 152, engaging member 26 is placed within the U-shaped receiving portion 84 and the container 50 is lifted to raise an edge 155 of the container off its underlying support surface 154 (FIG. 21). As the container 50 is lifted, the container 50 pivots about the engagement member 26 as described above with reference to FIG. 10. At removal steps 156-160, interlocking member 24 is retracted and the container 50 is pulled and positioned onto support member 20 with the interlocking member 24 still engaged with device engagement structure 68. At step 162, the container 50 is lowered for travel from the pallet 142 to a single-sided store display 120 at step 164. At this point, it should be noted that with the container 50 engaged with the interlocking member 24, the container guard 30 inhibits spilling of product from the container 50 by providing a temporary front wall barrier with front wall 58 of the container 50 repositioned at step 144. Additionally, by providing an at least somewhat transparent container guard 30, the user 145 can view the container 50 during the unload operation (see, e.g., step 148). In some embodiments, guides (not shown) such as markings on the container 50 and the handling apparatus 10 may be provided that aid the user in aligning the interlocking member 24 with the device engagement structure 68 of the container 50.

Referring now to FIGS. 20A through 20J, at step 166, the container 50 while still engaged with the interlocking member 24 is placed in its display configuration as described above by moving the top 52 and front 58 walls at joint B. At steps 168 and 170, an empty container 50' is broken-down by placing the container 50' in its collapsed configuration as described above. At step 172, the container 50 is moved vertically using the container manipulation device 18 to align the container with shelf 174 of the single-sided store display 120. At pushing steps 176 and 178, the container 50 is pushed along the support surface 22 and onto the shelf 174. The edge 155 of the container 50 is lowered onto the shelf 174 and the engaging member 26 is removed from the U-shaped receiving portion 84 at step 180. Other methods of container handling are described in pending U.S. patent application Ser. No. 11/089,424, entitled "Method for Product Handling Using a Display Configurable Container," filed the same day as the instant application, the content of which is hereby incorporated by reference as if fully set forth herein.

As noted above, the device engagement structure 68 of the container 50 extends inwardly from a periphery of the bottom wall 54. This allows for exposure of the device engagement structure 68 when the container 50 is in the collapsed configuration. At step 182, the user 145 can engage a stack 184 of collapsed containers 50 and place the stack 184 atop collapsed container 50' at steps 186 and 188. The user 145 can then engage the stack 184 including collapsed container 50' to transport the stack, for example, to a location for a washing operation where the containers can be washed and then reused and/or sent to a manufacturer or warehouse for refilling.

A number of detailed embodiments have been described. Nevertheless, it will be understood that various modifications may be made. For example, the containers 50 may include pallet structures, e.g., at the bottom of the containers that allow a handling apparatus, such as a forklift, to engage an underside of the container to lift the container from a shelf or off the ground. Additionally, the containers 50 may include stacking structures, such as ribs extend from the underside of the containers and mating grooves formed in the tops of the containers. The stacking structures can provided added stability when the containers are stacked one on top of the other. Accordingly, other embodiments are within the scope of the following claims.

What is claimed is:

1. A method of handling a non-hand held container using a container handling apparatus, the method comprising:

releasably engaging a box-shaped container with a container interlocking member of the container handling apparatus, the container having a horizontal top wall, a horizontal bottom wall and vertical side walls extending between the top wall and the bottom wall, the walls enclosing the interior of the container, the container having device engagement structure configured to mate with the container interlocking member and comprising a recess extending inward from an exterior edge of the bottom wall and an interior U-shaped receiving portion with an entrance end that is located inwardly of the exterior edge, the U-shaped receiving portion extends generally horizontally outward from the entrance end to a closed end located toward the exterior edge and includes top and bottom surface portions extending from the closed end to the entrance end, by (i) moving the container interlocking member in a inward horizontal direction into the recess, (ii) after step (i), raising the container interlocking member upward to locate the interlocking member at the entrance end of the U-shaped receiving portion, and (iii) after step (ii), moving the container interlocking member in a outward horizontal direction, opposite the inward horizontal direction, to place the container interlocking member within the U-shaped receiving portion of the container;

lifting the container using the container handling apparatus, the container interlocking member providing a pivot axis about which the container pivots relative to the interlocking member; and locating the container on a support member of the container handling apparatus by pulling the container in a direction toward the container handling apparatus using the interlocking member.

2. The method of claim 1 further comprising filling the container with an item through a fill opening; closing the fill opening to enclose an interior volume;

placing the container on a stack of containers; and providing a side access opening to the interior of the container by moving one side wall of the container relative to the bottom wall of the container, the one side wall being joined to the bottom wall.

3. The method of claim 2, wherein the one side wall is joined to the bottom wall through the top wall and another side wall.

4. The method of claim 3, wherein the step of providing a side access opening to the container occurs before the step of releasably engaging the container.

5. The method of claim 4, wherein the device engagement structure is located adjacent the side access opening.

6. The method of claim 5 further comprising moving the container to a display using the container handling apparatus.

7. The method of claim 6 further comprising providing a top access opening to the interior volume of the container by moving the top wall relative to the bottom wall of the container.

8. The method of claim 7, wherein the step of providing a top access opening to the interior occurs while the container is releasably engaged with the interlocking member.

9. The method of claim 7 further comprising locating the container on the display using the container handling apparatus.

10. The method of claim 9 further comprising collapsing the container by moving the top wall and the side walls of the container relative to the bottom wall to form a stack.

11. The method of claim 1 further comprising moving the support member vertically with the container located thereon.

12. The method of claim 11 further comprising moving the container interlocking member horizontally relative to the support member thereby pulling the container in the direction toward the container handling apparatus.

13. The method of claim 1, wherein the step of lifting the container includes lifting a front end of the container off an underlying support surface, the container pivoting about the interlocking member such that a rear end of the container remaining on the underlying support surface.

14. A method of handling a non-hand held container using a container handling apparatus, the method comprising:

releasably engaging a container having exterior side surfaces with a container interlocking member of the container handling apparatus, the container having device engagement structure integrally formed with the container and comprising a U-shaped receiving portion which is horizontally disposed within the exterior side surfaces and includes an entrance end, a lower surface, a top surface and a closed end opposite the entrance end, wherein the closed end of the horizontally disposed U-shaped receiving portion is disposed between the entrance end and an exterior side surface of the container, the device engagement structure configured to receive the container interlocking member within the U-shaped receiving portion of the device engagement structure, the container interlocking member being moved into the U-shaped receiving portion;

lifting a front end of the container off an underlying support surface using the container handling apparatus, the container interlocking member providing a pivot axis about which the container pivots relative to the interlocking member with the interlocking member within the U-shaped receiving portion such that a rear end of the container remains on the underlying support surface; and locating the container on a support member of the container handling apparatus by pulling the container in a direction toward the container handling apparatus using the interlocking member, the interlocking member engaging the closed end of the U-shaped receiving portion only after the interlocking member is pulled toward the container handling apparatus in a direction away from the entrance end.

15. The method of claim 14 wherein the releasably engaging step involves moving the interlocking member horizontally inward of the exterior side surface and then vertically thereby aligning the interlocking member with the entrance end of the U-shaped receiving portion.

16. The method of claim 14 wherein the step of releasably engaging the container with the interlocking member further comprises moving the interlocking member inward along a recess of the container, the recess providing a path that leads to the U-shaped receiving portion; then moving the interlocking member vertically along the path thereby locating the interlocking member at the entrance end to the U-shaped receiving portion; then moving the interlocking member outward thereby placing the interlocking member within the U-shaped receiving portion of the container interlocking member; then performing the step of lifting the front end of the container off the underlying support surface.

17. A method of handling a container, the method comprising:

moving a non-handed held container handling device into position adjacent a storage location of a container, the container handling device including an outwardly extending support member for receiving and supporting containers and a container interlocking member movable relative to the support member toward and away from a distal end of the support member, the support member vertically movable along the container handling device;

releasably engaging the container with the container interlocking member of the container handling apparatus by:

(i) moving the container interlocking member in a first horizontal direction into a receiving opening within a front end of the container such that the container interlocking member moves within a container structure defined by external surfaces of the container, (ii) after step (i), raising the container interlocking member upward to locate the container interlocking member at an entrance end to a horizontally disposed receiving slot, and (iii) after step (ii), moving the container interlocking member in a second horizontal direction, opposite the first horizontal direction, to place the container interlocking member within the horizontally disposed receiving slot of the container;

lifting a front end of the container off an underlying support surface of the storage location using the container handling apparatus, the container interlocking member interacting with the horizontally disposed receiving slot to provide a pivot axis about which the container pivots such that a rear end of the container remains on the underlying support surface; and moving the container interlocking member away from the distal end of the support member to pull the container onto the support member via interaction of the container interlocking member and a closed end of the horizontally disposed receiving slot.

18. The method of claim 17 wherein the receiving opening and horizontally disposed receiving slot are formed in a bottom wall of the container.

* * * * *

UNITED STATES PATENT AND TRADEMARK OFFICE

CERTIFICATE OF CORRECTION

PATENT NO. : 7,588,404 B2
APPLICATION NO. : 11/089429
DATED : March 24, 2009
INVENTOR(S) : James A. Sonon It is certified that error appears in the above-identified patent and that said Letters Patent is hereby corrected as shown below:

Column 8

Line 43, after "method of handling a" remove the phrase "non-hand held"

Line 44, before "container" insert --non-hand held--

Column 9

Line 54, after "method of handling a" remove the phrase "non-hand held"

Line 55, before "container" insert --non-hand held--

Signed and Sealed this

Sixteenth Day of March, 2010

David J. Kappos

David J. Kappos
*Director of the United States Patent and Trademark Office*